US008532546B2

(12) United States Patent
Nishigaki et al.

(10) Patent No.: US 8,532,546 B2
(45) Date of Patent: Sep. 10, 2013

(54) DEVELOPER SUPPLY DEVICE AND IMAGE FORMING APPARATUS HAVING THE SAME

(75) Inventors: Yuji Nishigaki, Gifu (JP); Masataka Maeda, Aichi (JP); Tomoaki Hazeyama, Mie (JP); Yasuhiro Maruyama, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 231 days.

(21) Appl. No.: 13/187,973

(22) Filed: Jul. 21, 2011

(65) Prior Publication Data

US 2012/0027471 A1 Feb. 2, 2012

(30) Foreign Application Priority Data

Jul. 30, 2010 (JP) ..... 2010-171718

(51) Int. Cl.
*G03G 15/08* (2006.01)

(52) U.S. Cl.
USPC ..... 399/281

(58) Field of Classification Search
USPC ..... 399/281
See application file for complete search history.

(56) References Cited

U.S. PATENT DOCUMENTS

| | | | | |
|---|---|---|---|---|
| 4,885,223 | A * | 12/1989 | Enoki et al. | 430/122.1 |
| 2005/0207769 | A1* | 9/2005 | Matsuda et al. | 399/53 |
| 2010/0158577 | A1* | 6/2010 | Nishiwaki | 399/266 |
| 2010/0303486 | A1* | 12/2010 | Shibata et al. | 399/43 |
| 2011/0188899 | A1* | 8/2011 | Nishiwaki | 399/285 |

FOREIGN PATENT DOCUMENTS

| | | |
|---|---|---|
| JP | 2005-173456 | 6/2005 |
| JP | 2010-145911 | 7/2010 |

* cited by examiner

*Primary Examiner* — David Gray
*Assistant Examiner* — Tyler Hardman
(74) *Attorney, Agent, or Firm* — Scully, Scott, Murphy & Presser, PC

(57) ABSTRACT

A developer supply device is provided, which includes a transfer board including an activating section and an always-transferring section. The activating section is disposed in a position close to a developer holding member and lower than a position where development agent is transferred onto the developer holding member. The activating section is supplied with an activating voltage for making the development agent leave a developer transfer path and drop into the developer storage section during an activating process performed at an initial stage of a developer transferring operation while supplied with the transfer bias voltage after the activating process. The always-transferring section is disposed across a position facing the developer storage section to a position lower than and adjacent to the activating section, and always supplied with a transfer bias voltage during the developer transferring operation.

12 Claims, 8 Drawing Sheets

DEVELOPER SUPPLY DEVICE AND IMAGE FORMING APPARATUS HAVING THE SAME

CROSS-REFERENCE TO RELATED APPLICATION

This application claims priority under 35 U.S.C. §119 from Japanese Patent Application No. 2010-171718 filed on Jul. 30, 2010. The entire subject matter of the application is incorporated herein by reference.

BACKGROUND

1. Technical Field

The following description relates to one or more developer supply devices configured to supply charged powdered development agent to an intended device.

2. Related Art

A developer supply device has been known, which includes a developer carrying member and a transfer board.

The developer carrying member is configured as a roller-shaped member that has a cylindrical circumferential surface facing the intended device. The transfer board includes a plurality of transfer electrodes arranged along a developer transfer path. The transfer board is configured to transfer development agent in a developer transfer direction along the developer transfer path by the action of an electric field generated when a predetermined voltage is applied to the transfer electrodes.

The transfer board includes a vertical transfer board and a bottom transfer board. The vertical transfer board extends vertically so as to transfer the development agent vertically upward in the developer transfer direction. The developer carrying member is disposed to face an upper end of the vertical transfer board. The bottom transfer board forms a bottom surface of a developer storage section. The bottom transfer board is connected with a lower end of the vertical transfer board. Thus, the bottom transfer board is configured to charge the development agent by friction with the development agent and transfer the charged development agent to the lower end of the vertical transfer board.

In order to generate an electric field to transfer the charged development agent from the upper end of the vertical transfer board to the development carrying member, a predetermined voltage is applied between the vertical transfer board and the developer carrying member.

In the developer supply device configured as above, the development agent is transferred by the vertical transfer board, vertically upward in the developer transfer direction along the developer transfer path. Then, in a position where the upper end of the vertical transfer board faces the developer carrying member, the charged development agent is transferred onto the developer carrying member by the action of the electric field generated in response to the predetermined voltage being applied between the vertical transfer board and the developer carrying member. Thus, the development agent is held and carried on the circumferential surface of the developer carrying member.

SUMMARY

In the developer supply device of this kind, when transferring of the development agent is once stopped, the development agent being transferred may be left behind on the transfer board (the vertical transfer board). In the case where the development agent left behind on the transfer board is transferred as is toward the developer carrying member when the transferring of the development agent is restarted, inadequately-charged development agent is carried on the developer carrying member. It might have a negative influence on quality of a formed image.

Aspects of the present invention are advantageous to provide one or more improved techniques for a developer supply device, which techniques make it possible to supply adequately-charged development agent to an intended device.

According to aspects of the present invention, a developer supply device is provided, which is configured to supply charged development agent to an intended device. The developer supply device includes a developer holding member including a developer holding surface formed as a cylindrical circumferential surface parallel to a first direction, the developer holding surface being disposed in closest proximity to and opposite the intended device in a first position, the developer holding member being configured to rotate around an axis parallel to the first direction such that the developer holding surface moves in a second direction perpendicular to the first direction, and to supply the development agent carried on the developer holding surface to the first position, a casing formed as a box-shaped member, the casing including a developer storage section configured to accommodate the development agent, and an opening provided in a position facing the intended device, the casing rotatably supporting the developer holding member at the opening such that the developer holding surface faces the intended device through the opening, and a transfer board disposed inside the casing, the transfer board including a plurality of transfer electrodes arranged along a substantially vertically-extending developer transfer path perpendicular to the first direction, the transfer board being configured to convey the development agent up toward a second position where the transfer board is in closest proximity to and opposite the developer holding surface, from the developer storage section along the developer transfer path and transfer the development agent onto the developer holding surface around the second position, under a traveling-wave transfer electric field generated when a transfer bias voltage containing a multi-phase alternating-current voltage component is applied to the transfer electrodes, and the transfer board further including an activating section disposed in a position close to the developer holding member and substantially lower than the second position, the activating section being supplied with an activating voltage for making the development agent leave the developer transfer path and drop into the developer storage section during an activating process performed at an initial stage of a developer transferring operation of transferring the development agent, the activating section being supplied with the transfer bias voltage after the activating process, and an always-transferring section disposed across at least a range of a position facing the developer storage section to a position lower than and adjacent to the activating section, the always-transferring section being always supplied with the transfer bias voltage during the developer transferring operation.

According to aspects of the present invention, further provided is an image forming apparatus including a photoconductive body configured such that a development agent image is formed thereon, and a developer supply device configured to supply charged development agent to the photoconductive body. The developer supply device includes a developer holding member including a developer holding surface formed as a cylindrical circumferential surface parallel to a first direction, the developer holding surface being disposed in closest proximity to and opposite the photoconductive body in a first position, the developer holding member being configured to rotate around an axis parallel to the first direction such that the developer holding surface moves in a second direction perpendicular to the first direction, and to supply the development agent carried on the developer holding surface to the first position, a casing formed as a box-shaped member, the casing including a developer storage section configured to accommodate the development agent, and an opening provided in a position facing the photoconductive body, the casing rotatably supporting the developer holding member at the opening such that the developer holding surface faces the photoconductive body through the opening, and a transfer board disposed inside the casing, the transfer board including a plurality of transfer electrodes arranged along a substantially vertically-extending developer transfer path perpendicular to the first direction, the transfer board being configured to convey the development agent up toward a second position where the transfer board is in closest proximity to and opposite the developer holding surface, from the developer storage section along the developer transfer path and transfer the development agent onto the developer holding surface around the second position, under a traveling-wave transfer electric field generated when a transfer bias voltage containing a multi-phase alternating-current voltage component is applied to the transfer electrodes, and the transfer board further including an activating section disposed in a position close to the developer holding member and substantially lower than the second position, the activating section being supplied with an activating voltage for making the development agent leave the developer transfer path and drop into the developer storage section during an activating process performed at an initial stage of a developer transferring operation of transferring the development agent, the activating section being supplied with the transfer bias voltage after the activating process, and an always-transferring section disposed across at least a range of a position facing the developer storage section to a position lower than and adjacent to the activating section, the always-transferring section being always supplied with the transfer bias voltage during the developer transferring operation.

BRIEF DESCRIPTION OF THE ACCOMPANYING DRAWINGS

Figure 4A:
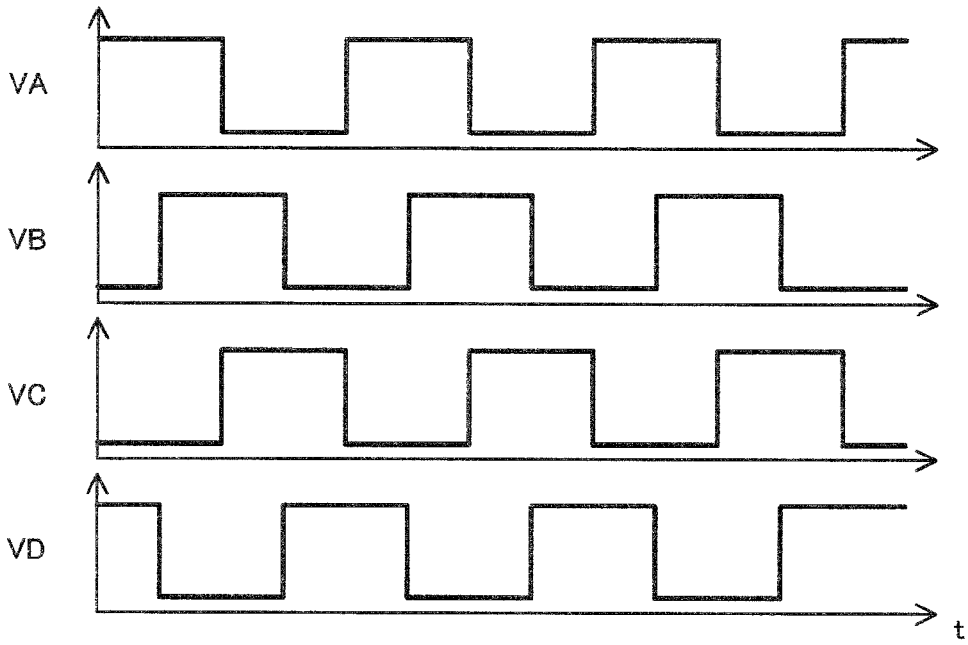
Figure 4B:
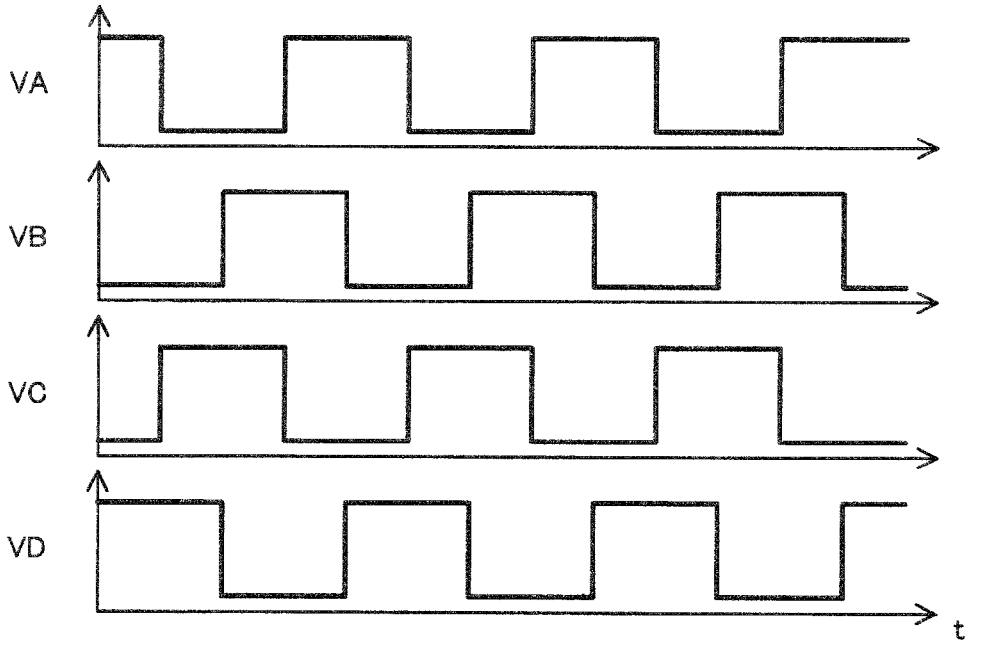

FIGS. 4A and 4B exemplify respective waveforms of voltages output from four power supply circuits for each transfer board in the embodiment according to one or more aspects of the present invention.

Figure 5:
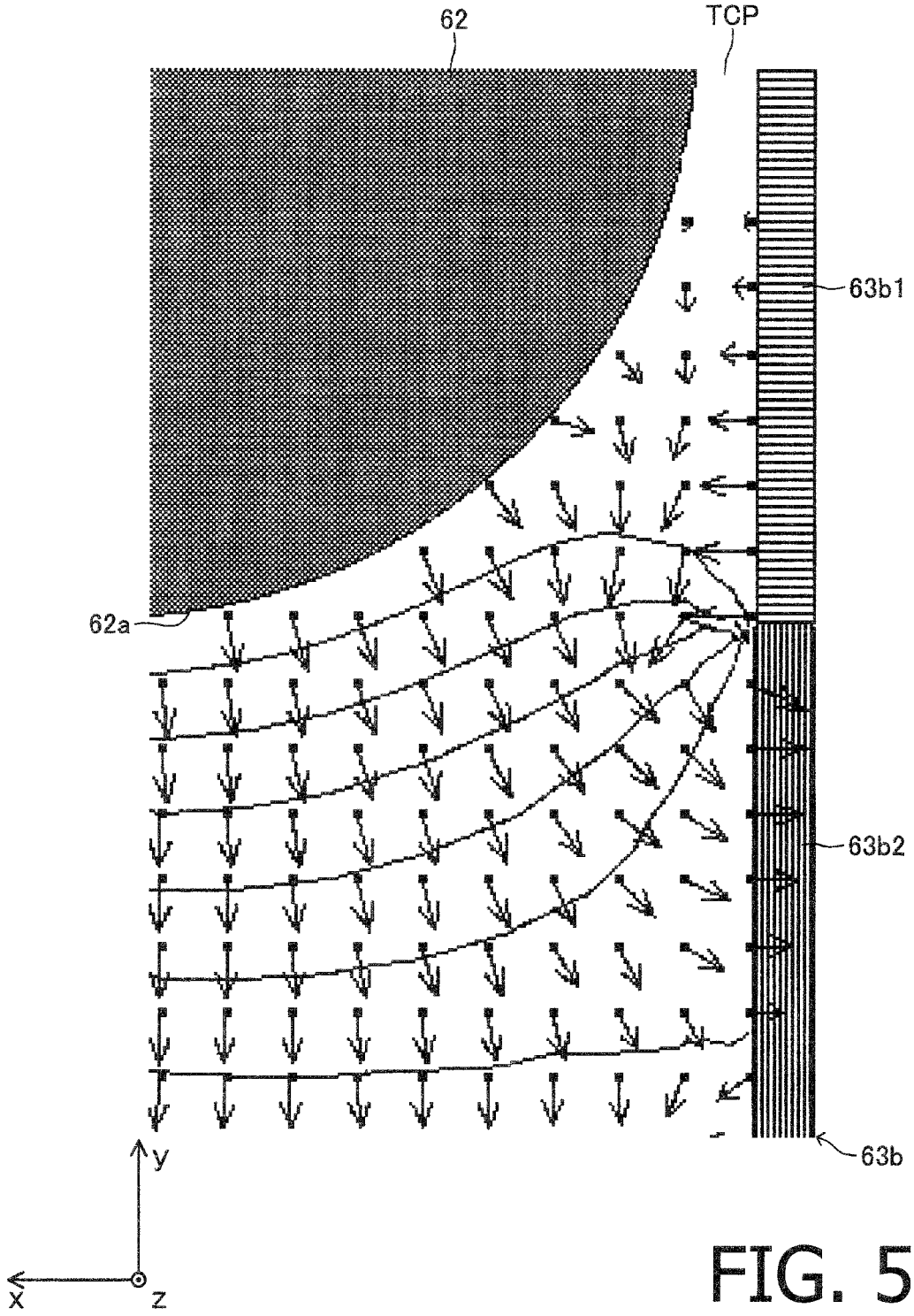

FIG. 5 shows a simulation result for verifying an operation and an effect in a modification employing an activating voltage as illustrated in FIG. 4B in accordance with one or more aspects of the present invention.

Figure 6:
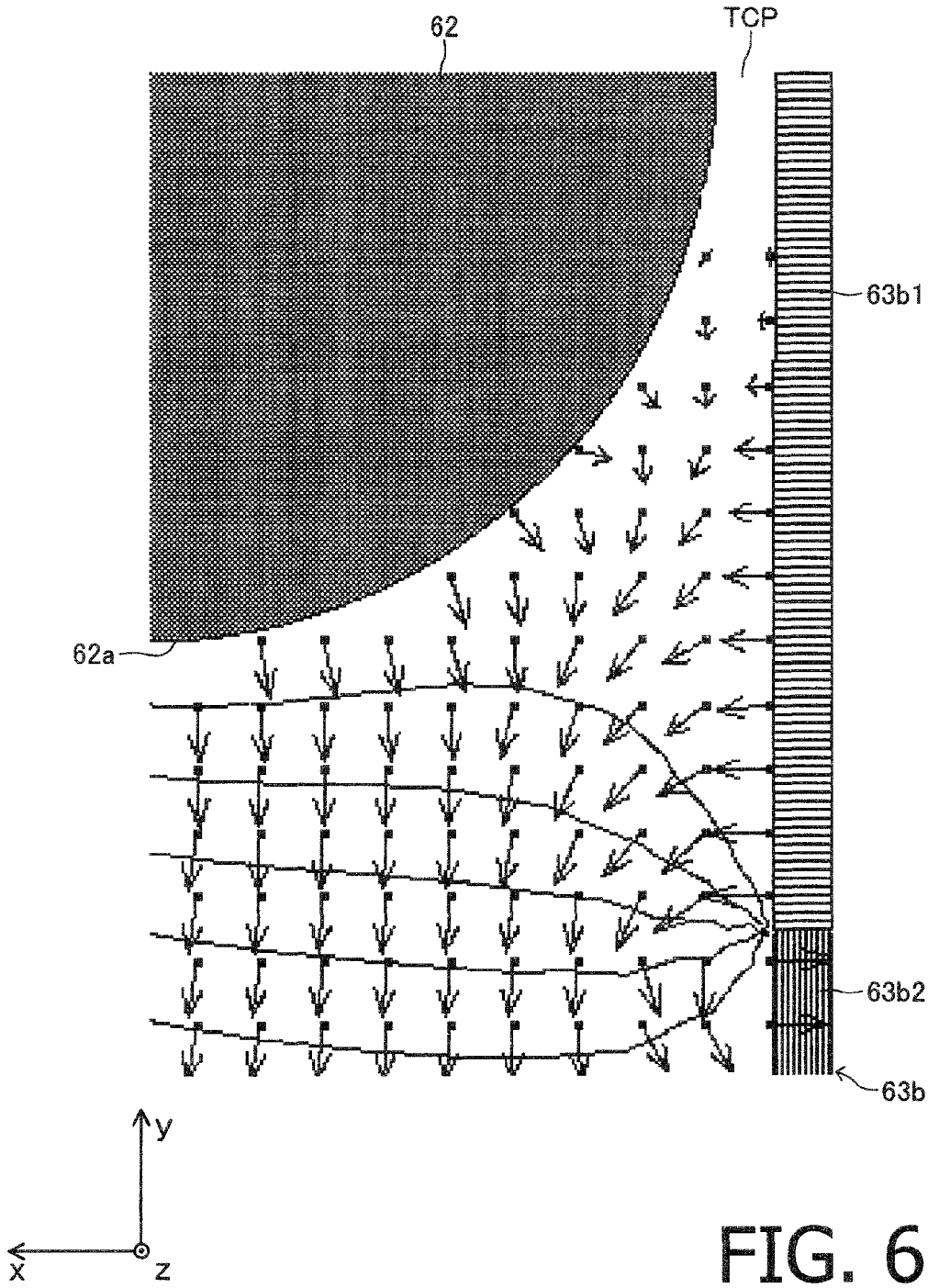

FIG. 6 shows a simulation result for verifying an operation and an effect in a modification employing a different configuration from that shown in FIG. 5 in accordance with one or more aspects of the present invention.

Figure 7:
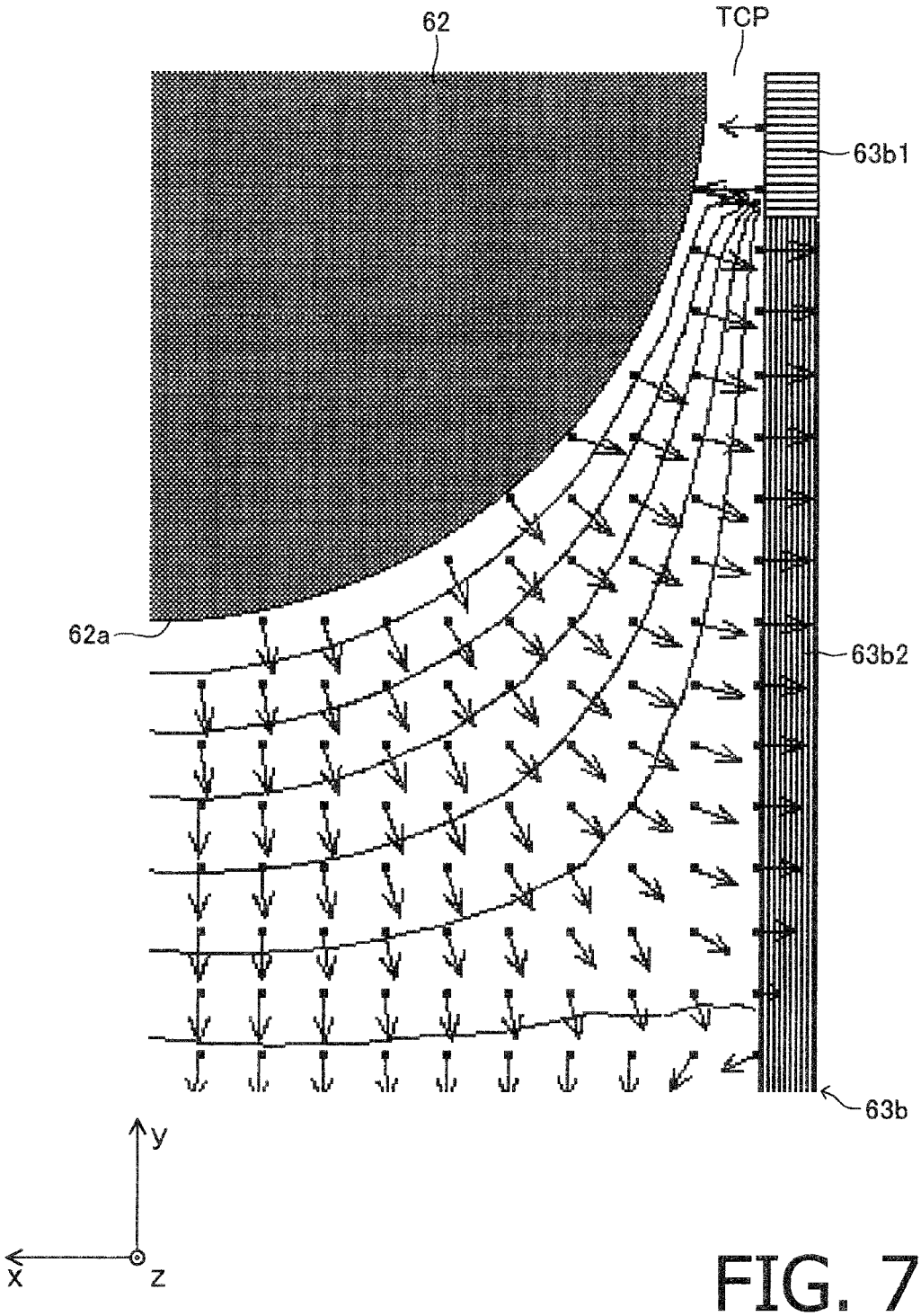

FIG. 7 shows a simulation result for verifying an operation and an effect in a comparative example employing a different configuration from those shown in FIGS. 5 and 6.

Figure 8:
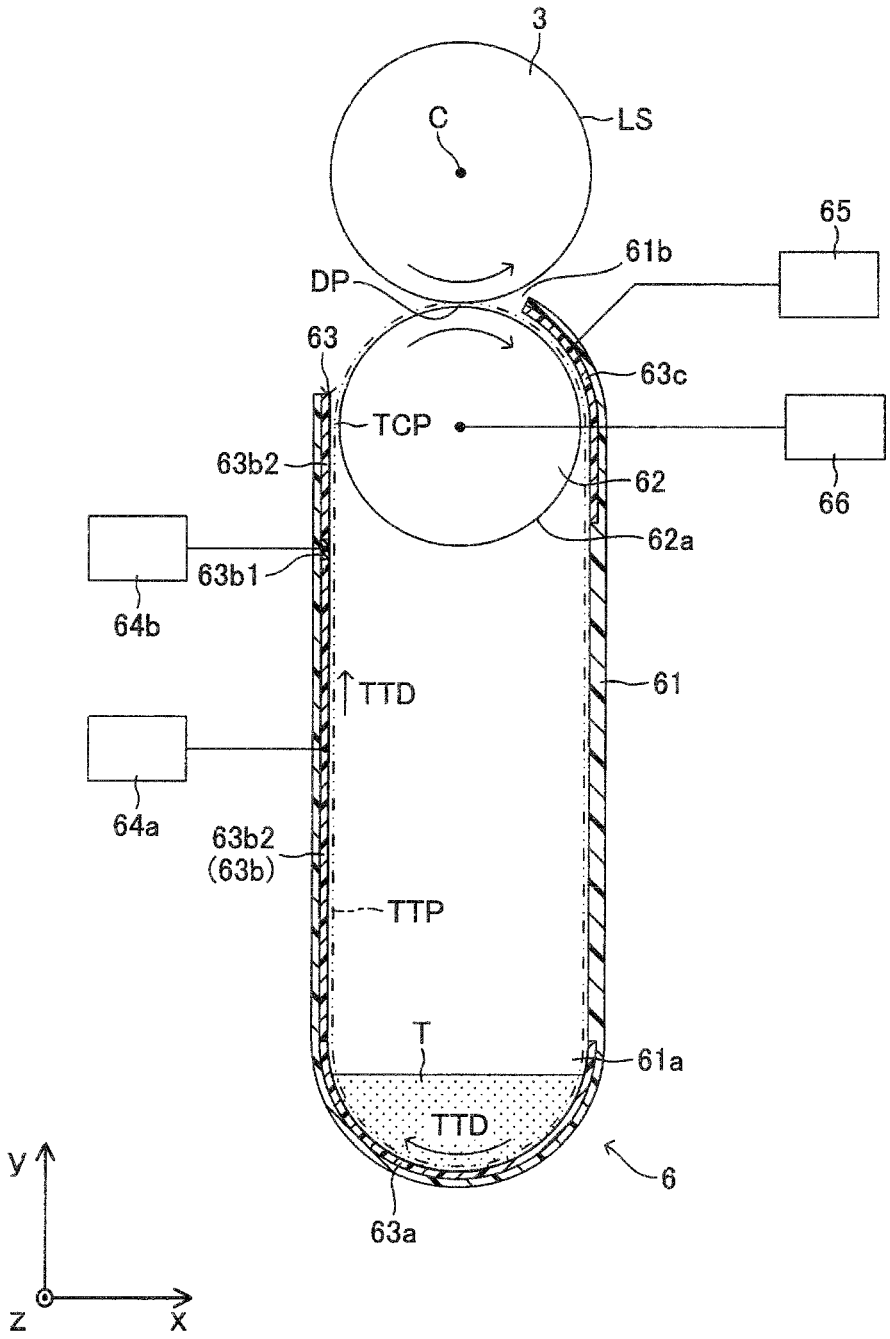

FIG. 8 is an enlarged cross-sectional side view of a toner supply device for the laser printer in a modification according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings.

<Configuration of Laser Printer>

Figure 1:
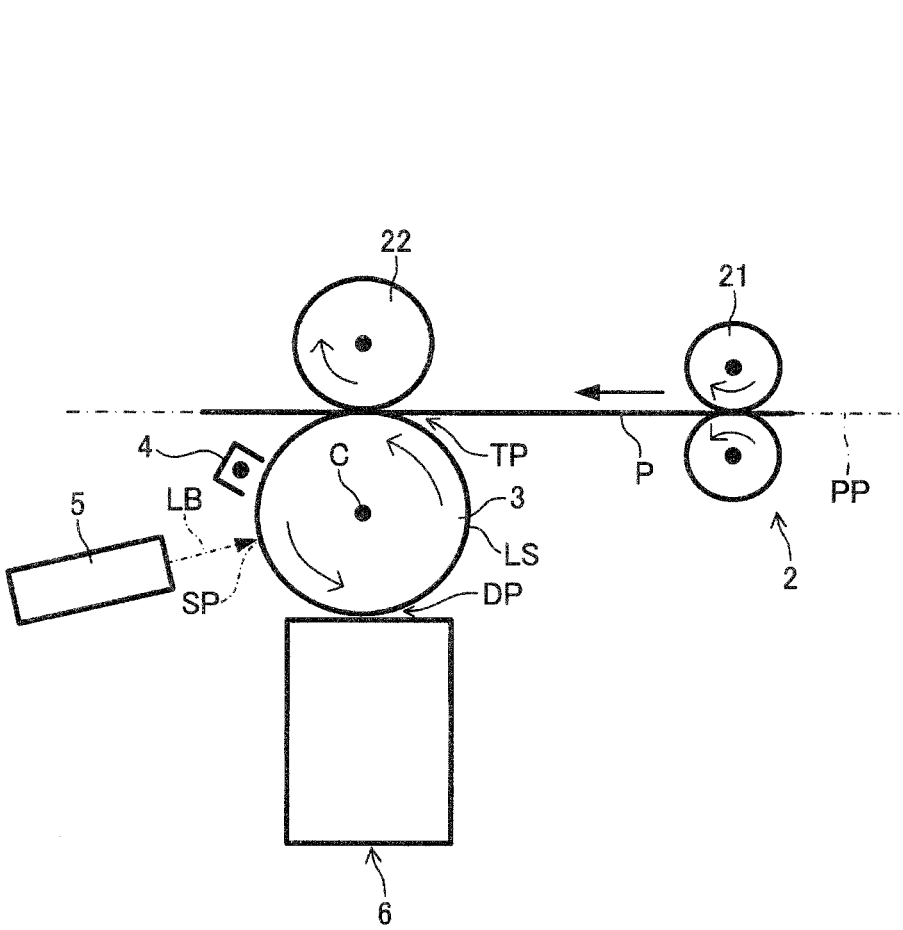
FIG. 1 is a side view schematically showing a configuration of a laser printer in an embodiment according to one or more aspects of the present invention.
Figure 1:
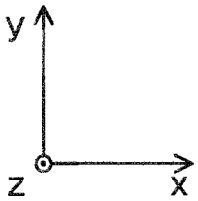

As illustrated in FIG. 1, a laser printer 1 includes a sheet feeding mechanism 2, a photoconductive drum 3, an electrification device 4, a scanning unit 5, and a toner supply device 6.

A feed tray (not shown), provided in the laser printer 1, is configured such that a stack of sheets P is placed thereon. The sheet feeding mechanism 2 is configured to feed the sheets P placed on the feed tray, on a sheet-by-sheet basis along a predetermined sheet feeding path PP.

On a circumferential surface of the photoconductive drum 3, an electrostatic latent image holding surface LS is formed as a cylindrical surface parallel to a main scanning direction (i.e., a z-axis direction in FIG. 1, hereinafter which may be referred to as a width direction). The electrostatic latent image holding surface LS is configured such that an electrostatic latent image is formed thereon in accordance with an electric potential distribution. Further, the electrostatic latent image holding surface LS is configured to hold and carry toner T (see FIG. 2) in positions corresponding to the electrostatic latent image. The photoconductive drum 3 is driven to rotate in a predetermined direction (counterclockwise in FIG. 1) around a central axis parallel to the main scanning direction. Thereby, the photoconductive drum 3 is configured to move the electrostatic latent image holding surface LS along an auxiliary scanning direction perpendicular to the main scanning direction.

The electrification device 4 is disposed to face the electrostatic latent image holding surface LS, so as to evenly and positively charge the electrostatic latent image holding surface LS. The scanning unit 5 is configured to generate a laser beam LB modulated based on image data and to scan the laser beam LB, which is converged in a scanned position SP on the electrostatic latent image holding surface LS, along the main scanning direction. Namely, the scanning unit 5 is configured such that an electrostatic latent image is formed on the electrostatic latent image holding surface LS.

The toner supply device 6 is disposed under the photoconductive body 3, so as to face the photoconductive body 3 in a development position DP which is downstream relative to the scanned position SP in a moving direction of the electrostatic latent image holding surface LS moving in response to rotation of the photoconductive drum 3. The toner supply device 6 is configured to supply the positively charged toner T (see FIG. 2) from underneath to the electrostatic latent image holding surface LS in the development position DP. Subsequently, a detailed explanation will be provided about a specific configuration of each element included in the laser printer 1.

The sheet feeding mechanism 2 includes a pair of registration rollers 21 and a transfer roller 22. The registration rollers 21 are configured to feed a sheet P toward a transfer position TP (which is downstream relative to the development position DP in the moving direction of the electrostatic latent image holding surface LS moving in response to rotation of the photoconductive drum 3) between the photoconductive drum 3 and the transfer roller 22 at a predetermined moment.

The transfer roller 22 is disposed to face the electrostatic latent image holding surface LS across the sheet feeding path PP (the sheet P) in the transfer position TP. Additionally, the transfer roller 22 is driven to rotate in a direction (clockwise in FIG. 1) opposite to the rotational direction of the photoconductive drum 3. Further, the transfer roller 22 is connected with a transfer bias power supply circuit (not shown), such that a predetermined transfer bias voltage is applied for transferring, onto the sheet P, the toner T (see FIG. 2) adhering onto the electrostatic latent image holding surface LS.

<<Toner Supply Device>>

Figure 2:
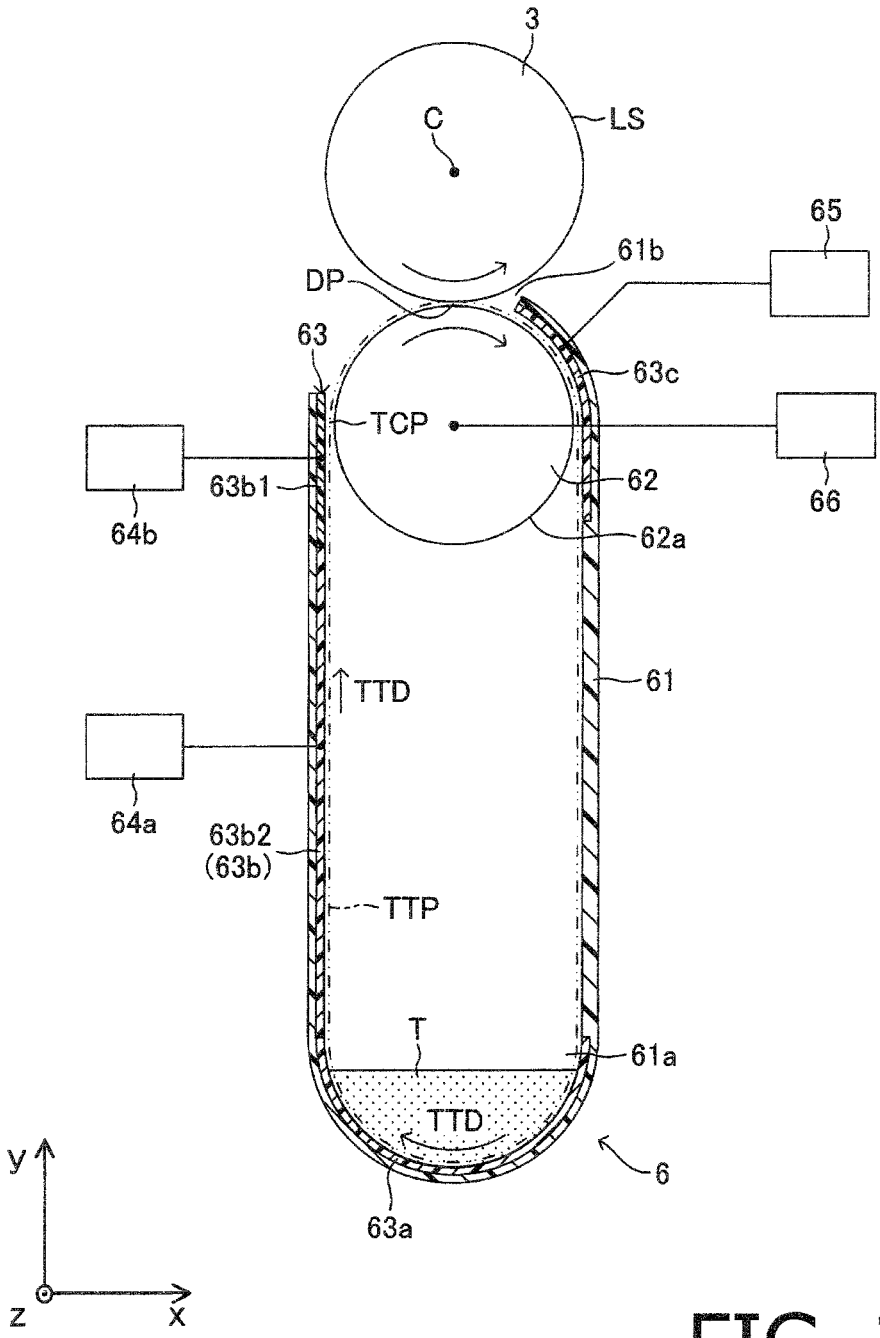
FIG. 2 is an enlarged cross-sectional side view of a toner supply device for the laser printer in the embodiment according to one or more aspects of the present invention.

As depicted in FIG. 2 that is a cross-sectional side view showing the toner supply device 6 in an enlarged manner, the toner supply device 6 is configured to transfer the positively charged toner T along a toner transfer path TTP under a traveling-wave transfer electric field and supply the toner T to the photoconductive drum 3.

A toner box 61, which forms a casing of the toner supply device 6, is a box-shaped member that is formed in an oval shape when viewed in the z-axis direction. Further, the toner box 61 is disposed to have a longitudinal direction parallel to an up-to-down direction (i.e., the y-axis direction in FIG. 2, which may be referred to as a vertical direction). The toner box 61 is configured to accommodate the toner T that is powdered dry development agent. Namely, the toner box 61 includes a toner storage section 61*a*, which is an internal space formed in a half-cylinder shape at the bottom of the toner box 61. In the embodiment, it is noted that the toner T is positively-chargeable nonmagnetic-one-component black toner. Further, the toner box 61 includes an opening 61*b* provided at the top thereof, i.e., in the position to face the photoconductive drum 3.

There is a development roller 62 housed in the toner box 61. The development roller 62 is rotatably supported by the toner box 61. The development roller 62 is a roller-shaped member having a toner holding surface 62*a* that is a cylindrical circumferential surface. The development roller 62 is disposed at the opening 61*b* so as to face the photoconductive drum 3. Namely, the development roller 62 is supported by the toner box 61 such that in the development position DP, the toner holding surface 62*a* of the development roller 62 is in closest proximity to and opposite the electrostatic latent image holding surface LS of the photoconductive drum 3 across a predetermined distance.

<<<Transfer Board>>>

There is a transfer board 63 provided along the toner transfer path TTP inside the toner box 61. The transfer board 63 is fixed on an inner wall surface of the toner box 61. In the embodiment, the transfer board 63 includes a bottom transfer board 63*a*, a vertical transfer board 63*b* (containing an always-transferring section 63*b*2 and an activating section 63*b*1), and a retrieving transfer board 63*c*. It is noted that a detailed explanation will be provided below about an internal configuration of the transfer board 63 (the bottom transfer board 63*a*, the vertical transfer board 63*b*, and the retrieving transfer board 63*c*).

The bottom transfer board 63*a* is disposed at a bottom portion of the internal space of the toner box 61, so as to form a bottom surface of the toner storage section 61*a*. The bottom transfer board 63*a*, which is a concave curved surface formed in a half-cylinder shape when viewed in the z-axis direction, is smoothly connected with a lower end of the vertical transfer board 63*b*. Specifically, the bottom transfer board 63*a* is connected with the lower end of the vertical transfer board 63*b* so as to transfer the toner T stored in the toner storage section 61*a* toward the lower end of the vertical transfer board 63*b*.

The vertical transfer board 63*b* is formed in a flat plate shape and provided to extend vertically so as to transfer the toner T, received from the bottom transfer board 63*a*, vertically upward. In a toner carrying position TCP where the upper end of the vertical transfer board 63*b* is in closest proximity to and opposite the development roller 62 (the toner holding surface 62*a*), there is a predetermined distance of gap provided between the vertical transfer board 63*b* and the toner holding surface 62*a*. In the embodiment, as described above, the vertical transfer board 63*b* includes the activating section 63*b*1 and the always-transferring section 63*b*2.

The activating section 63*b*1 is disposed in the vicinity of the development roller 62 (the toner holding surface 62*a*). Specifically, in the embodiment, the activating section 63*b*1 extends from the upper end of the vertical transfer board 63*b* to a portion thereof lower than the toner carrying position TCP. Namely, an upper end of the activating section 63*b*1 is disposed in a position as high as the upper end of the vertical transfer board 63*b*. Further, a lower end of the activating section 63*b*1 is disposed in a position substantially as high as a lower end of the development roller 62.

The always-transferring section 63*b*2 is disposed to be adjacent to the activating section 63*b*1, beneath the activating section 63*b*1. Specifically, an upper end of the always-transferring section 63*b*2 is disposed to be adjacent to the lower end of the activating section 63*b*1. Further, a lower end of the always-transferring section 63*b*2 is disposed in a position as high as the lower end of the vertical transfer board 63*b* that faces the toner storage section 61*a*.

The activating section 63*b*1 is configured to make the toner T leave the toner transfer path TTP and drop toward the toner storage section 61*a* in an activating process to be performed in an initial stage of an operation of the vertical transfer board 63*b* to transfer (or resume transferring) the toner T. Further, the activating section 63*b*1 is configured to, after the activating process, transfer the toner T in a toner transfer direction TTD heading for the toner carrying position TCP from the toner storage section 61*a*. Meanwhile, the always-transferring section 63*b*2 is configured to always transfer the toner T in the toner transfer direction TTD heading for the toner carrying position TCP from the toner storage section 61*a* while the vertical transfer board 63*b* is conveying the toner T thereon.

The retrieving transfer board 63*c* is disposed to face the development roller 62 on the opposite side of the upper end of the vertical transfer board 63*b* across the development roller 62. Namely, the retrieving transfer board 63*c* is disposed downstream relative to the opening 61*b* of the toner box 61 in the toner transfer direction TTD. In the embodiment, a downstream end of the retrieving transfer board 63*c* in the toner transfer direction TTD is placed in a position substantially as high as the lower end of the development roller 62.

The retrieving transfer board 63*c* is configured to retrieve the toner T, which remains on the toner holding surface 62*a* without being consumed in the development position DP, from the development roller 62 and to convey the retrieved toner T down toward the toner storage section 61*a*. Specifically, an upper portion of the retrieving transfer board 63*c* is bent in a shape of a concave curved surface shape so as to face the development roller 62 across a predetermined distance of gap. Further, a lower portion of the retrieving transfer board 63*c* is configured to transfer the toner T vertically downward.

<<<Power Supply Circuit>>>

The bottom transfer board 63*a* and the always-transferring section 63*b*2 of the vertical transfer board 63*b* are electrically connected with an always-transferring power supply circuit 64*a*. The activating section 63*b*1 of the vertical transfer board 63*b* is electrically connected with an activating power supply circuit 64*b*. The retrieving transfer board 63*c* is electrically connected with a retrieving power supply circuit 65. The development roller 62 is electrically connected with a development bias power supply circuit 66.

The always-transferring power supply circuit 64*a* is configured to generate a traveling-wave transfer electric field to transfer the toner T in the toner transfer direction TTD on the bottom transfer board 63*a* and the always-transferring section 63*b*2 when a transfer bias voltage containing a multi-phase alternating-current (AC) voltage component is applied to a plurality of transfer electrodes 631 (see FIG. 3) of the bottom transfer board 63*a* and the always-transferring section 63*b*2 of the vertical transfer board 63*b*.

The activating power supply circuit 64*b* is configured to, when applying a predetermined activating voltage to a plurality of transfer electrodes 631 (see FIG. 3) of the activating section 63*b*1 of the vertical transfer board 63*b* in the activating process, generate on the activating section 63*b*1 such a transfer electric field as to make the toner T leave the toner transfer path TTP and drop toward the toner storage section 61*a*. Further, the activating power supply circuit 64*b* is configured to, when applying a transfer bias voltage (see FIG. 4A) to the plurality of transfer electrodes 631 of the activating section 63*b*1 after the activating process, generate the aforementioned transfer electric field on the activating section 63*b*1. Specifically, in the embodiment, the activating power supply circuit 64*b* outputs a reverse transfer bias voltage (see FIG. 4B) for generating such a traveling-wave reverse transfer electric field as to transfer the toner T in a direction opposite to the toner transfer direction TTD, in the activating process.

The retrieving power supply circuit 65 is configured to apply, to a plurality of transfer electrodes 631 (see FIG. 3) of the retrieving transfer board 63*c*, such a retrieving bias voltage containing a multi-phase AC voltage component as to retrieve the toner T from the development roller 62 (the toner holding surface 62*a*) on the retrieving transfer board 63*c* and transfer the retrieved toner T vertically down toward the toner storage section 61*a* under a traveling-wave retrieving transfer electric field. The retrieving bias voltage is set to provide an average electric potential lower than an electric potential of an exposed region, of the electrostatic latent image holding surface LS, to be supplied with the toner T.

The development bias power supply circuit 66 is configured to apply to between the vertical transfer board 63*b* and the development roller 62 such a development bias voltage as to generate an electric field for transferring the positively charged toner T from the vertical transfer board 63*b* toward the development roller 62.

Additionally, the always-transferring power supply circuit 64*a*, the activating power supply circuit 64*b*, the retrieving power supply circuit 65, and the development bias power supply circuit 66 are configured to output respective voltages required for circulating the toner T in the toner transfer direction TTD along the toner transfer path TTP (i.e., for conveying the toner T stored in the toner storage section 61*a* to the toner carrying position TCP on the vertical transfer board 63*b*, transferring the toner T onto the development roller 62 around the toner carrying position TCP, once having the toner holding surface 62*a* carry the toner T thereon, retrieving from the development roller 62 the toner T left there without being consumed in the development position DP, and conveying the retrieved toner T back down to the toner storage section 61*a*), in a normal electric-field transferring operation of transferring the toner T after the activating process.

Specifically, the always-transferring power supply circuit 64*a* is configured to output a rectangular four-phase AC voltage of +400 V to +1000 V (amplitude: 300 V, and DC offset: +700 V) with a frequency of 300 Hz (see FIG. 4A). Meanwhile, the activating power supply circuit 64*b* is configured to, in the activating process, output a four-phase AC voltage (see FIG. 4B) that has the same waveform as that of the voltage output from the always-transferring power supply circuit 64*a* and a phase shift direction opposite to that of the voltage output from the always-transferring power supply circuit 64*a*. In addition, the activating power supply circuit 64*b* is configured to, after the activating process, output the same voltage as that output from the always-transferring power supply circuit 64*a*.

Further, the retrieving power supply circuit 65 is configured to output a rectangular AC voltage of −300 V to +300 V (amplitude: 300 V, and DC offset: 0 V) with a frequency of 300 Hz (see FIG. 4A). Moreover, the development bias power supply circuit 66 is configured to output a direct-current (DC) voltage with a DC offset of +400 V.

<<<Internal Configuration of Transfer Board>>>

Figure 3:
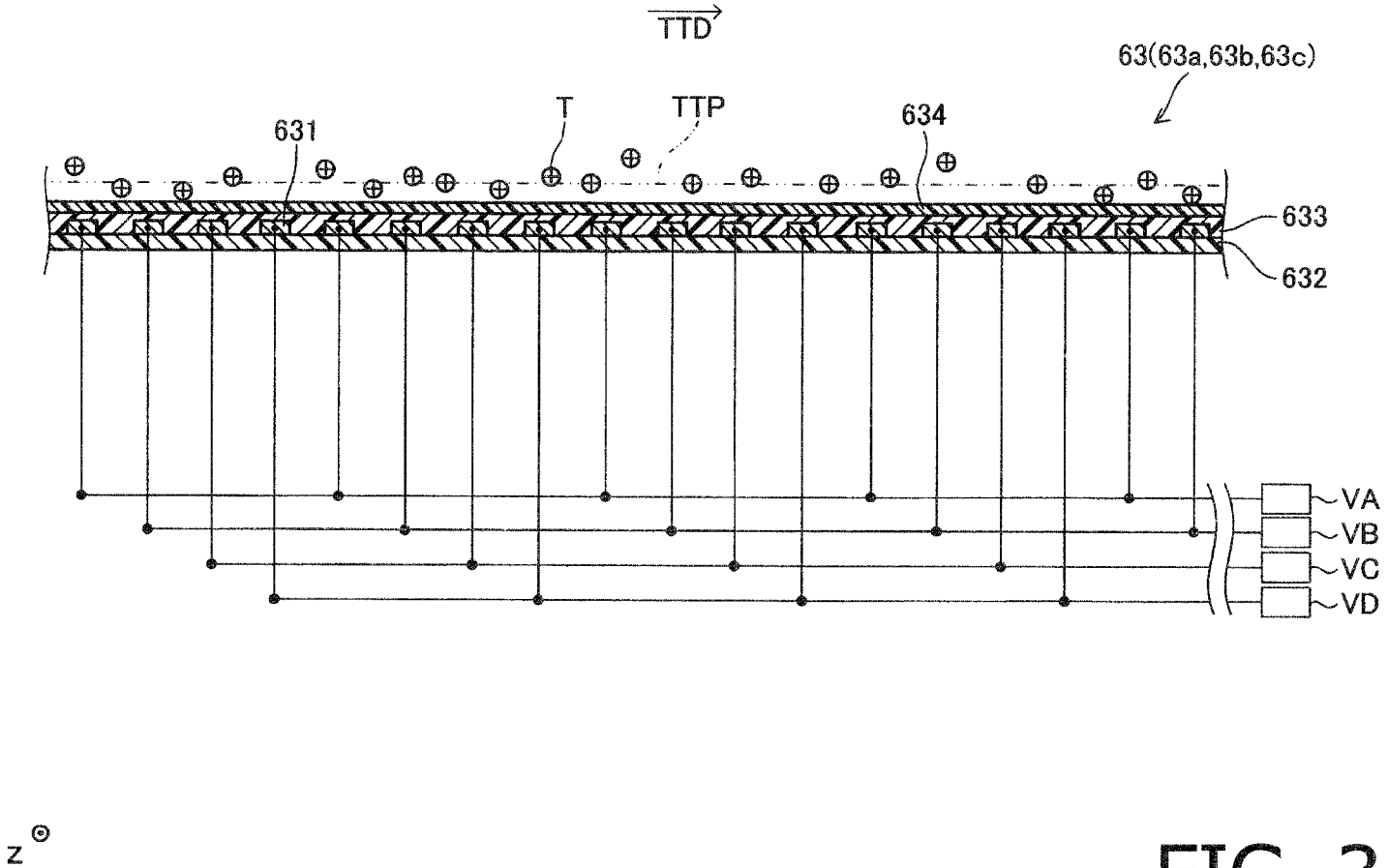
FIG. 3 is an enlarged cross-sectional side view of each transfer board for the toner supply device in the embodiment according to one or more aspects of the present invention.

Referring to FIG. 3, the transfer board 63 is a thin plate member configured in the same manner as a flexible printed-circuit board. Specifically, the transfer board 63 includes the transfer electrodes 631, a transfer electrode supporting film 632, a transfer electrode coating layer 633, and a transfer electrode overcoating layer 634.

Each transfer electrode 631 is a linear wiring pattern having a longitudinal direction parallel to the main scanning direction (i.e., perpendicular to the auxiliary scanning direction), and made of a copper thin film. The transfer electrodes 631 are arranged parallel to each other along the toner transfer path TTP.

Every fourth one of the transfer electrodes 631, arranged along the toner transfer path TTP, is connected with a specific one of four power supply circuits VA, VB, VC, and VD. In other words, the transfer electrodes 631 are arranged along the toner transfer path TTP in the following order: a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, a transfer electrode 631 connected with the power supply circuit VA, a transfer electrode 631 connected with the power supply circuit VB, a transfer electrode 631 connected with the power supply circuit VC, a transfer electrode 631 connected with the power supply circuit VD, . . . (note: the power supply circuits VA, VB, VC, and VD are included in each power supply circuit shown in FIG. 2 such as the always-transferring power supply circuit 64*a* and the activating power supply circuit 64*b*).

FIGS. 4A and 4B exemplify waveforms of the voltages output from the power supply circuits VA, VB, VC, and VD shown in FIG. 3. In the embodiment, as illustrated in FIGS. 4A and 4B, the power supply circuits VA, VB, VC, and VD are configured to generate respective AC driving voltages having substantially the same waveform. Further, the power supply circuits VA, VB, VC, and VD are configured to generate the respective AC driving voltages with a phase difference of 90 degrees between any adjacent two of the power supply circuits VA, VB, VC, and VD in the aforementioned order.

As depicted in FIG. 4A, the always-transferring power supply circuit 64*a* is configured such that the power supply circuits VA, VB, VC, and VD thereof always output the respective AC driving voltages each of which is delayed by a phase of 90 degrees behind the voltage output from a precedent adjacent one of the power supply circuits VA, VB, VC, and VD in the aforementioned order. Meanwhile, as depicted in FIG. 4B, the activating power supply circuit 64*b* is configured such that in the activating process, the power supply circuits VA, VB, VC, and VD thereof output the respective AC driving voltages each of which is advanced by a phase of 90 degrees ahead of the voltage output from a precedent adjacent one of the power supply circuits VA, VB, VC, and VD in the aforementioned order. Further, as depicted in FIG. 4A, the activating power supply circuit 64*b* is configured such that after the activating process, the power supply circuits VA, VB, VC, and VD thereof output the respective AC driving voltages each of which is delayed by a phase of 90 degrees behind the voltage output from a precedent adjacent one of the power supply circuits VA, VB, VC, and VD in the aforementioned order.

The transfer electrodes 631 are formed on a surface of the transfer electrode supporting film 632. The transfer electrode supporting film 632 is a flexible film made of electrically insulated synthetic resin such as polyimide resin.

The transfer electrode coating layer 633 is made of electrically insulated synthetic resin. The transfer electrode coating layer 633 is provided to coat the transfer electrodes 631 and a surface of the transfer electrode supporting film 632 on which surface the transfer electrodes 631 are formed.

On the transfer electrode coating layer 633, the transfer electrode overcoating layer 634 is provided. Namely, the transfer electrode coating layer 633 is formed between the transfer electrode overcoating layer 634 and the transfer electrodes 631. The surface of the transfer electrode overcoating layer 634 is formed as a smooth surface with a very low level of irregularity, so as to smoothly convey the toner T.

<General Overview of Operations of Laser Printer>

Subsequently, a general overview will be provided of operations of the laser printer 1 configured as above with reference to the relevant drawings.

<<Sheet Feeding Operation>>

Referring to FIG. 1, firstly, a leading end of a sheet P placed on the feed tray (not shown) is fed to the registration rollers 21. The registration rollers 21 perform skew correction for the sheet P, and adjust a moment when the sheet P is to be fed forward. After that, the sheet P is fed to the transfer position TP.

<<Formation of Toner Image on Electrostatic Latent Image Holding Surface>>

While the sheet P is being conveyed to the transfer position TP as described above, an image of the toner T (hereinafter referred to as a toner image) is formed on the electrostatic latent image holding surface LS that is the outer circumferential surface of the photoconductive drum 3, as will be mentioned below.

<<Formation of Electrostatic Latent Image>>

Firstly, the electrostatic latent image holding surface LS of the photoconductive drum 3 is charged evenly and positively by the electrification device 4. The electrostatic latent image holding surface LS, charged by the electrification device 4, is moved along the auxiliary scanning direction to the scanned position SP to face the scanning unit 5, when the photoconductive drum 3 rotates in the direction indicated by arrows in FIG. 1.

In the scanned position SP, the electrostatic latent image holding surface LS is exposed to the laser beam LB modulated based on the image data. Namely, while being scanned along the main scanning direction, the laser beam LB is rendered incident onto the electrostatic latent image holding surface LS. In accordance with the modulation of the laser beam LB, areas with no positive charge remaining thereon are generated on the electrostatic latent image holding surface LS. Thereby, an electrostatic latent image is formed with a positive charge pattern (positive charges distributed in the shape of an image) on the electrostatic latent image holding surface LS.

The electrostatic latent image, formed on the electrostatic latent image holding surface LS, is transferred to the development position DP to face the toner supply device 6 when the photoconductive drum 3 rotates in the direction indicated by the arrows in FIG. 1.

<<Transfer and Supply of Charged Toner>>

Referring to FIGS. 2 and 3, the toner T stored in the toner box 61 is charged due to contact or friction with the transfer electrode overcoating layer 634 on the bottom transfer board 63*a*. The charged toner T, which is in contact with or proximity to the transfer electrode overcoating layer 634 on the bottom transfer board 63*a*, is conveyed in the toner transfer direction TTD by the traveling-wave electric field generated when the aforementioned transfer bias voltage is applied to the transfer electrodes 631 of the bottom transfer board 63*a*. Thereafter, the charged toner T is transferred to the vertical transfer board 63*b*.

In the embodiment, a downstream end of the bottom transfer board 63*a* in the toner transfer direction TTD, i.e., a joint portion of the bottom transfer board 63*a* with the vertical transfer board 63*b* is formed as a curved surface. Thereby, the toner T is smoothly transferred from the bottom transfer board 63*a* to the lower end of the vertical transfer board 63*b*.

The vertical transfer board 63*b* conveys the toner T, received at the lower end thereof from the bottom transfer board 63*a*, vertically up toward the toner carrying position TCP. During the time period, the toner T is further charged up due to contact or friction with the transfer electrode overcoating layer 634 of the vertical transfer board 63*b*.

The toner T transferred from the bottom transfer board 63*a* to the vertical transfer board 63*b* contains uncharged toner for some reasons (e.g., the uncharged toner contained may be caught up by an airflow). Nonetheless, in the embodiment, the uncharged toner leaves the toner transfer path TTP and drops from the vertical transfer board 63*b* by the action of the gravity. Then, the toner T, which has dropped from the vertical transfer board 63*b*, returns into the toner storage section 61*a*.

The toner T being conveyed on the vertical transfer board 63*b* reaches the vicinity of the toner carrying position TCP, in a state further charged up in the aforementioned manner to a predetermined charged level. In the vicinity of the toner carrying position TCP, the positively charged toner T is transferred onto the toner holding surface 62*a* by the action of the development bias voltage.

The toner holding surface 62*a*, onto which the toner T has been transferred in the vicinity of the toner carrying position TCP, moves in the direction perpendicular to the main scanning direction when the development roller 62 is driven to rotate, and then reaches the vicinity of the development position DP. In the vicinity of the development position DP, the toner T carried on the toner holding surface 62*a* is supplied to the photoconductive drum 3. Namely, the electrostatic latent image formed on the electrostatic latent image holding surface LS is developed with the toner T. Specifically, the toner T adheres onto the areas where there is no positive charge remaining on the electrostatic latent image holding surface LS. Thereby, the image of the toner T (i.e., the toner image) is held and carried on the electrostatic latent image holding surface LS.

The toner T, which remains on the toner holding surface 62*a* (without being consumed in the development position DP) even after passing through the development position DP, is transferred onto the retrieving transfer board 63*c* by the action of a retrieving electric field generated between the development roller 62 (the toner holding surface 62*a*) and the retrieving transfer board 63*c* when the aforementioned retrieving bias voltage is applied to the retrieving transfer board 63*c*. Namely, the toner T is retrieved from the toner holding surface 62*a* by the retrieving transfer board 63*c*.

In the embodiment, the retrieving bias voltage containing the multi-phase AC voltage component is applied to the retrieving transfer board 63*c* while the DC voltage is applied to the development roller 62. Therefore, by the action of the AC voltage component of the retrieving bias voltage, the toner T carried on the toner holding surface 62*a* is vibrated in the vicinity of the retrieving transfer board 63*c*. Owing to the vibration of the toner T, the toner T floating above the toner holding surface 62*a* collides against the toner T adhering onto the toner holding surface 62*a*. Thereby, the toner T carried on the toner holding surface 62*a* becomes more likely to float apart from the toner holding surface 62*a*.

Further, in the embodiment, the average electric potential (0 V) of the retrieving bias voltage is set lower than the electric potential (240 V) of the exposed region, of the electrostatic latent image holding surface LS, to be supplied with the toner T. By the action of the retrieving bias voltage, the toner T, which remains on the toner holding surface 62*a* without being consumed even after passing through the development position DP, is removed in a preferable manner and transferred onto the retrieving transfer board 63*c*. Thus, it is possible to prevent generation of a ghost on the formed image as effectively as practicable.

The toner T, transferred onto the retrieving transfer board 63*c* from the toner holding surface 62*a*, is conveyed down toward the toner storage section 61*a* by the action of the electric field generated when the retrieving bias voltage is applied to the transfer electrodes 631 of the retrieving transfer board 63*c*. At the lower end of the retrieving transfer board 63*c*, the toner T is conveyed vertically downward. At this time, an inertia force acts on the toner T in the same direction as the gravity. Then, in a region below the lower end of the retrieving transfer board 63*c*, the toner T drops into the toner storage section 61*a* by the action of the gravity and the inertia force in the same direction as the gravity. Hence, even though the retrieving transfer board 63*c* is not provided up to the toner storage section 61*a*, the retrieved toner T is returned into the toner storage section 61*a* in a preferable manner.

<<Transfer of Toner Image from Electrostatic Latent Image Holding Surface onto Sheet>>

Referring to FIG. 1, the toner image, which is held and carried on the electrostatic latent image holding surface LS of the photoconductive drum 3 as described above, is conveyed to the transfer position TP when the electrostatic latent image holding surface LS moves in the auxiliary scanning direction in response to the photoconductive drum 3 rotating in the direction as indicated by the arrows in FIG. 1 (i.e., counter-clockwise in FIG. 1). Then, in the transfer position TP, the toner image is transferred from the electrostatic latent image holding surface LS onto the sheet P. After that, the toner image is fixed onto the sheet P by a fixing unit (not shown). Thereby, the toner image is formed on the sheet P.

<Operations and Effects>

When a toner transferring operation of transferring the toner T on the transfer board 63 is suspended, the toner T may remain on the toner transfer path TTP (i.e., adhere onto the transfer board 63).

Such residual toner (especially, toner remaining on the vertical transfer board 63*b*) is not adequately charged at the time to reach the vicinity of the toner holding position TCP, as a transfer distance for the residual toner to the toner holding position TCP is not sufficiently ensured. Hence, in the case where the residual toner is conveyed as is toward the development roller 62 at the time when the toner transferring operation is resumed, inadequately charged residual toner might be held on the development roller 62 and exert a negative influence on the formed image.

In the embodiment, the activating process is carried out at the initial stage of the toner transferring operation (including an initial stage after resuming the toner transferring operation. For example, the laser printer 1 performs the activating process at the time when starting a first image forming operation after being powered on, an image forming operation after waiting for job data, or an image forming operation after maintenance such as re-supply of sheets and settlement of a paper jam.

In the activating process, the rotating of the development roller 62 is stopped. Further, a reverse transfer bias voltage is applied as an activating voltage to the transfer electrodes 631 of the activating section 63*b*1 that is disposed near the development roller 62 and blow the toner holding position TCP. Meanwhile, even in the activating process, the normal transfer bias voltage is applied to the always-transferring section 63*b*2 disposed across a range of a position facing the toner storage section 61*a* to a position lower than and adjacent to the activating section 63*b*1.

Thereby, residual toner on the activating section 63*b*1 is conveyed downward (to get away from the toner carrying position TCP) from the toner carrying position TCP by the action of the activating voltage. Then, at a boundary between the lower end of the activating section 63*b*1 and the upper end of the always-transferring section 63*b*2 (i.e., at a portion where a reverse transfer electric field collides against the transfer electric field), the residual toner leaves the toner transfer path TTP and drops into the toner storage section 61*a*.

Meanwhile, residual toner on the always-transferring section 63*b*2 is pushed out by the action of the transfer electric field or by newly transferred toner T to reach the boundary between the lower end of the activating section 63*b*1 and the upper end of the always-transferring section 63*b*2. The residual toner stays once at the boundary as transferring of the residual toner in the toner transfer direction TTD is blocked there. Nonetheless, the residual toner soon leaves the toner transfer path TTP and drops into the toner storage section 61*a* due to its own weight (therefore, a time period during which the residual toner is staying at the boundary is actually short).

Thus, the residual toner remaining on the toner transfer path TTP (i.e., adhering onto the transfer board 63) leaves the toner transfer path TTP and drops into the toner storage section 61*a* without being transferred onto the toner holding surface 62*a* in the toner carrying position TCP.

After the residual toner is removed from the toner transfer path TTP in a preferable manner, the activating process is terminated. Thereafter, the normal transfer bias voltage is applied to the activating section 63*b*1 such that a normal toner transferring operation is performed on the transfer board 63.

Therefore, in the embodiment, adequately charged toner T is always conveyed to (the vicinity of) the toner carrying position TCP on the transfer board 63 and transferred onto the toner holding surface 62*a* in (the vicinity of) the toner carrying position TCP. Thus, according to the embodiment, it is possible to always supply the adequately charged toner T to the photoconductive drum 3 (the electrostatic latent image holding surface LS).

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

<Modifications>

Aspects of the present invention may be applied to electrophotographic image forming apparatuses such as color laser printers, and monochrome and color copy machines, as well as the single-color laser printer as exemplified in the aforementioned embodiment. Further, the photoconductive body is not limited to the drum-shaped one as exemplified in the aforementioned embodiment. For instance, the photoconductive body may be formed in the shape of a plate or an endless belt.

Additionally, light sources (e.g., LEDs, electroluminescence devices, and fluorescent substances) other than a laser scanner may be employed as light sources for exposure. In such cases, the "main scanning direction" may be parallel to a direction in which light emitting elements such as LEDs are arranged.

Further, for example, aspects of the present invention may be applied to negatively chargeable development agent or a negatively chargeable photoconductive body.

Alternatively, aspects of the present invention may be applied to image forming apparatuses employing methods (e.g., a toner-jet method using no photoconductive body, an ion flow method, and a multi-stylus electrode method) other than the aforementioned electrophotographic method.

The development roller 62 may be disposed in contact with the photoconductive drum 3. Further, the development roller 62 may be substitutable for a cylindrical development sleeve.

As long as the vertical transfer board 63*b* extends substantially in the vertical direction, the vertical transfer board 63*b* may be slightly tilted with respect to the vertical direction. In addition, the lower end of the retrieving transfer board 63*c* may be slightly tilted with respect to the vertical direction. Further, between the upper end (near the toner carrying position TCP) and the lower end of the vertical transfer board 63*b*, there may be provided a curved portion having a down-facing transfer surface on which the toner T is transferred.

A central portion of the bottom transfer board 63*a* may be flat. Namely, only a joint portion of the bottom transfer board 63*a* with the lower end of the vertical transfer board 63*b* may be curved.

The downstream end of the retrieving transfer board 63*c* in the toner transfer direction TTD may be connected with the bottom transfer board 63*a*.

The configuration of the transfer board 63 is not limited to that as exemplified in the aforementioned embodiment. For example, the transfer board 63 may be configured without the transfer electrode overcoating layer 634. Alternatively, the transfer board 63 may be configured with the transfer electrodes 631 being implanted in the transfer electrode supporting film 632. In this case, the transfer board 63 may be configured without the transfer electrode coating layer 633 or the transfer electrode overcoating layer 634.

Referring to FIG. 4A, the waveform of the voltage output from each of the power supply circuits VA, VB, VC, and VD may be a sinusoidal waveform or a triangle waveform, instead of the rectangular waveform as exemplified in the aforementioned embodiment.

In the aforementioned embodiment, the four power supply circuits VA, VB, VC, and VD are provided to generate respective voltages with a phase difference of 90 degrees between any adjacent two of the four power supply circuits VA, VB, VC, and VD in the aforementioned order. However, three power supply circuits may be provided to generate respective voltages with a phase difference of 120 degrees between any two of the three power supply circuits.

In the aforementioned embodiment, the activating section 63*b*1 and the always-transferring section 63*b*2 are connected with the respective different power supply circuits. However, the activating section 63*b*1 and the always-transferring section 63*b*2 may be connected with the same power supply circuit, which may be configured with an appropriately-designed wiring pattern for supplying an electric power to the transfer electrodes 631 of the activating section 63*b*1.

The activating voltage applied to the transfer electrodes 631 of the activating section 63*b*1 may be a voltage containing only a DC voltage component, instead of the reverse transfer bias voltage as exemplified in the aforementioned embodiment.

FIG. 5 shows a simulation result for verifying an operation and an effect of a modification employing the activating voltage as illustrated in FIG. 4B. It is noted that the state shown in FIG. 5 is a mirror-reversed image of the state shown in FIG. 2 owing to settings for the simulation, but it does not exert any negative influence on the simulation result.

In FIG. 5, each arrow represents both magnitude and direction of a force acting on toner, and each curved line shows a constant-electric-potential line. The activating voltage applied to the activating section 63*b*1 is +800 V. The development bias voltage applied to the development roller 62 is +800 V. The DC voltage component of the transfer bias voltage applied to the always-transferring section 63*b*2 is +500 V (the amplitude of the AC voltage component is 300 V).

Namely, in the modification (where the toner is charged positively), the following relational expression is established:

$$V2<V1=V3,$$

where V1, V2, and V3 represent the electric potential of the transfer electrodes 631 (see FIG. 3) of the activating section 63*b*1, the electric potential of the transfer electrodes 631 (see FIG. 3) of the always-transferring section 63*b*2, and the electric potential of the development roller 62, respectively.

Further, FIGS. 6 and 7 show simulation results when the activating voltage contains only a DC voltage component in the same manner as the case shown in FIG. 5 and the lower end of the activating section 63*b*1 is disposed in different positions from the position shown in FIG. 5.

As shown in FIG. 7, when the lower end of the activating section 63*b*1 is too close to the toner carrying position TCP (i.e., when it is not necessarily certain that the activating section 63*b*1 is substantially disposed lower than the toner carrying position TCP), such an electric field is generated that the toner heads for the toner holding surface 62*a* in the vicinity of the toner carrying position TCP. Additionally, at the boundary between the lower end of the activating section 63*b*1 and the upper end of the always-transferring section 63*b*2, the toner is pressed against the vertical transfer board 63*b* by the action of such a strong electric field as to head the toner for the vertical transfer board 63*b* from the development roller 62. Namely, even though toner is once removed from the toner transfer path TTP (see FIG. 2) by the activating section 63*b*1, the toner is captured by the strong electric field and pressed against the vertical transfer board 63*b*. Thus, in the configuration as shown in FIG. 7, it is impossible to make the residual toner drop into the toner storage section 61*a* (see FIG. 2) in a preferable manner.

On the contrary, as shown in FIGS. 5 and 6, when the lower end of the activating section 63*b*1 is disposed far from the toner carrying position TCP (i.e., when the activating section 63*b*1 is substantially disposed lower than the toner carrying position TCP), the aforementioned problem is not caused, and the residual toner can be dropped without being carried on the toner holding surface 62*a*.

FIG. 5 shows a configuration that the lower end of the activating section 63*b*1 is disposed substantially as high as the lower end of the development roller 62. In addition FIG. 6 shows a configuration that the lower end of the activating section 63*b*1 is disposed lower than the lower end of the development roller 62.

According to the configuration shown in FIG. 5, such an electric field as to head the toner for the vertical transfer board 63*b* from the development roller 62 is weak, while such an electric field as to head the toner downward from the activating section 63*b*1 is generated in a favorable fashion. Thereby, when the toner conveyed upward by the always-transferring section 63*b*2 reaches the boundary between the lower end of the activating section 63*b*1 and the upper end of the always-transferring section 63*b*2, the toner is prevented from being conveyed further upward and gradually accumulated at the boundary. Then, when it becomes difficult for the transfer board 62*b* to hold the toner, the toner drops in a favorable manner.

In order to increase a cleaning area on the vertical transfer board 63*b* where the residual toner is removed from the toner transfer path TTP in the activating process, the lower end of the activating section 63*b*1 is desired to be disposed as close to the toner carrying position TCP as possible within a range where it is possible to drop the toner in a favorable manner (e.g., as the configuration shown in FIG. 5). Nonetheless, it is possible to apply the configuration shown in FIG. 6 as well, which configuration makes it possible to generate such an electric field as to head the toner downward from the activating section 63*b*1 in a preferable fashion. Namely, the lower end of the activating section 63*b*1 is desired to be disposed around or lower than the lower end of the toner holding surface 62*a* (the lower end of the activating section 63*b*1 may be disposed in a position slightly higher than the lower end of the toner holding surface 62*a* as far as such a configuration makes it possible to drop the toner in a favorable manner).

It is noted that the aforementioned requirement (relation) "V1=V3" may not necessarily be satisfied. The same effects may be provided under the following relation:

$$V2<V1\leqq V3.$$

The aforementioned relations among the electric potentials V1, V2, and V3 may be applied to the aforementioned embodiment (where in the activating process, the reverse transfer bias voltage is applied as the activating voltage to the transfer electrodes 631 of the activating section 63*b*1).

Further, when the toner is charged negatively, the relation among the electric potentials V1, V2, and V3 is desired as follows:

$$V3\leqq V1<V2.$$

The activating section 63*b*1 may be provided up to a position higher than the toner carrying position TCP, or provided only below the toner carrying position TCP. As illustrated in FIG. 8, the activating section 63*b*1 may be disposed only in an area around the lower end of the toner holding surface 62*a*. In this case, the activating section 63*b*1 may be disposed within an area as large as one to several pieces of transfer electrodes (see FIG. 3).

The development bias voltage applied to the development roller 62 may contain only a DC voltage component (including the level of ground). Further, the various bias voltages may be changed as needed.

What is claimed is:

1. A developer supply device configured to supply charged development agent to an intended device, comprising:

a developer holding member comprising a developer holding surface formed as a cylindrical circumferential surface parallel to a first direction, the developer holding surface being disposed in closest proximity to and opposite the intended device in a first position, the developer holding member being configured to rotate around an axis parallel to the first direction such that the developer holding surface moves in a second direction perpendicular to the first direction, and to supply the development agent carried on the developer holding surface to the first position;

a casing formed as a box-shaped member, the casing comprising:

a developer storage section configured to accommodate the development agent; and an opening provided in a position facing the intended device, the casing rotatably supporting the developer holding member at the opening such that the developer holding surface faces the intended device through the opening; and a transfer board disposed inside the casing, the transfer board comprising a plurality of transfer electrodes arranged along a substantially vertically-extending developer transfer path perpendicular to the first direction, the transfer board being configured to convey the development agent up toward a second position where the transfer board is in closest proximity to and opposite the developer holding surface, from the developer storage section along the developer transfer path and transfer the development agent onto the developer holding surface around the second position, under a traveling-wave transfer electric field generated when a transfer bias voltage containing a multi-phase alternating-current voltage component is applied to the transfer electrodes, and the transfer board further comprising:

an activating section disposed in a position close to the developer holding member and substantially lower than the second position, the activating section being supplied with an activating voltage for making the development agent leave the developer transfer path and drop into the developer storage section during an activating process performed at an initial stage of a developer transferring operation of transferring the development agent, the activating section being supplied with the transfer bias voltage after the activating process; and an always-transferring section disposed across at least a range of a position facing the developer storage section to a position lower than and adjacent to the activating section, the always-transferring section being always supplied with the transfer bias voltage during the developer transferring operation.

2. The developer supply device according to claim 1, wherein when the charged development agent to be supplied is positively charged, a condition "$V2<V1\leqq V3$" is satisfied, wherein when the charged development agent to be supplied is negatively charged, a condition "$V3\leqq V1<V2$" is satisfied, wherein V1, V2, and V3 represent an electric potential of the transfer electrodes of the activating section, an electric potential of the transfer electrodes of a portion of the transfer board other than the activating section, and an electric potential of the developer holding member, during the activating process, respectively.

3. The developer supply device according to claim 1, wherein the activating section is supplied during the activating process with a reverse transfer bias voltage for generating a traveling-wave electric field that travels in an opposite direction to a traveling direction of the transfer electric field.

4. The developer supply device according to claim 1, wherein a lower end of the activating section is disposed in a position substantially as high as a lower end of the developer holding member.

5. The developer supply device according to claim 2, wherein a lower end of the activating section is disposed in a position substantially as high as a lower end of the developer holding member.

6. The developer supply device according to claim 3, wherein a lower end of the activating section is disposed in a position substantially as high as a lower end of the developer holding member.

7. An image forming apparatus comprising:

a photoconductive body configured such that a development agent image is formed thereon; and a developer supply device configured to supply charged development agent to the photoconductive body, the developer supply device comprising:

a developer holding member comprising a developer holding surface formed as a cylindrical circumferential surface parallel to a first direction, the developer holding surface being disposed in closest proximity to and opposite the photoconductive body in a first position, the developer holding member being configured to rotate around an axis parallel to the first direction such that the developer holding surface moves in a second direction perpendicular to the first direction, and to supply the development agent carried on the developer holding surface to the first position;

a casing formed as a box-shaped member, the casing comprising:

a developer storage section configured to accommodate the development agent; and an opening provided in a position facing the photoconductive body, the casing rotatably supporting the developer holding member at the opening such that the developer holding surface faces the photoconductive body through the opening; and a transfer board disposed inside the casing, the transfer board comprising a plurality of transfer electrodes arranged along a substantially vertically-extending developer transfer path perpendicular to the first direction, the transfer board being configured to convey the development agent up toward a second position where the transfer board is in closest proximity to and opposite the developer holding surface, from the developer storage section along the developer transfer path and transfer the development agent onto the developer holding surface around the second position, under a traveling-wave transfer electric field generated when a transfer bias voltage containing a multi-phase alternating-current voltage component is applied to the transfer electrodes, and the transfer board further comprising:

an activating section disposed in a position close to the developer holding member and substantially lower than the second position, the activating section being supplied with an activating voltage for making the development agent leave the developer transfer path and drop into the developer storage section during an activating process performed at an initial stage of a developer transferring operation of transferring the development agent, the activating section being supplied with the transfer bias voltage after the activating process; and an always-transferring section disposed across at least a range of a position facing the developer storage section to a position lower than and adjacent to the activating section, the always-transferring section being always supplied with the transfer bias voltage during the developer transferring operation.

8. The image forming apparatus according to claim 7, wherein when the charged development agent to be supplied is positively charged, a condition "$V2<V1\leqq V3$" is satisfied, wherein when the charged development agent to be supplied is negatively charged, a condition "$V3\leqq V1<V2$" is satisfied, wherein V1, V2, and V3 represent an electric potential of the transfer electrodes of the activating section, an electric potential of the transfer electrodes of a portion of the transfer board other than the activating section, and an electric potential of the developer holding member, during the activating process, respectively.

9. The image forming apparatus according to claim 7, wherein the activating section is supplied during the activating process with a reverse transfer bias voltage for generating a traveling-wave electric field that travels in an opposite direction to a traveling direction of the transfer electric field.

10. The image forming apparatus according to claim 7, wherein a lower end of the activating section is disposed in a position substantially as high as a lower end of the developer holding member.

11. The image forming apparatus according to claim 8, wherein a lower end of the activating section is disposed in a position substantially as high as a lower end of the developer holding member.

12. The image forming apparatus according to claim 9, wherein a lower end of the activating section is disposed in a position substantially as high as a lower end of the developer holding member.

* * * * *